US007363732B1

(12) United States Patent
Hernandez

(10) Patent No.: US 7,363,732 B1
(45) Date of Patent: Apr. 29, 2008

(54) WEIGHT SPORTERS ATHLETIC SHOE

(76) Inventor: Tony Sergio Hernandez, 1455 Nolan Ct., Chula Vista, CA (US) 91911

( * ) Notice: Subject to any disclaimer, the term of this patent is extended or adjusted under 35 U.S.C. 154(b) by 266 days.

(21) Appl. No.: 11/010,917

(22) Filed: Dec. 14, 2004

(51) Int. Cl.
*A43B 5/00* (2006.01)

(52) U.S. Cl. ..... 36/132; 36/114; 36/136

(58) Field of Classification Search ..... 36/132, 36/136, 114; 482/105
See application file for complete search history.

(56) References Cited

U.S. PATENT DOCUMENTS

| | | | | |
|---|---|---|---|---|
| 2,545,910 | A * | 3/1951 | Aprile | 36/132 |
| 3,785,646 | A * | 1/1974 | Ruskin | 482/105 |
| 4,430,810 | A * | 2/1984 | Bente | 36/32 R |
| 6,397,498 | B1 * | 6/2002 | Yoo | 36/132 |
| 6,583,370 | B2 * | 6/2003 | Stoneberg | 177/264 |
| 6,742,288 | B2 * | 6/2004 | Choi | 36/132 |
| 2002/0017039 | A1 * | 2/2002 | Hines | 36/132 |
| 2004/0035025 | A1 * | 2/2004 | Choi | 36/132 |
| 2006/0010720 | A1 * | 1/2006 | Kim | 36/132 |

FOREIGN PATENT DOCUMENTS

EP 346298 A2 * 12/1989

* cited by examiner

*Primary Examiner*—Marie Patterson

(57) ABSTRACT

Weight sporters is a shoe that *utilizes the rubber sole of the shoe to hold five weights of different circular sizes, by means of circular cavities manufactured along the side of the rubber sole. Weights are attached and secured by means of a turning knob on each top edge of the weight they are secured by means of a rubber pressure ring on the top edge of each weight and are machined threaded. The weights may be worn in all variations, using one, two, five or none at all etc. In other variants of the invention the shoe weights may also be covered with a smooth rubber plastic.

13 Claims, 3 Drawing Sheets

WEIGHT SPORTERS ATHLETIC SHOE

FIELD OF INVENTION

This invention pertains to the field of athletic shoes. In detail the invention relates to a rubber sole pertaining to an athletic shoe designed for exercising while walking, by the use of inserted circular weights. These weights being variable and of one shape.

BACKGROUND OF INVENTION

Many shoe designs have been developed in the last twenty years using the integration of weights and shoes for the purpose of exercise. U.S. Pat. No. 6,052,924 issued to Jack M. Sabat incorporates various different shapes of weights and uses various buckles and fasteners to adjust the variable weights.

U.S. Pat. No. 5,638,613 issued to James H. Williams uses flat weights that have been embodied in an interchangeable shoe insole. There is also U.S. Pat. No. 5,231,776 issued to Wagner, U.S. Pat. No. 4,709,921 issued to Valuikas, U.S. Pat. No. 3,114,982 issued to Mcgowan, U.S. Pat. No. 3,109,245 issued to R. P. Glynn, U.S. Pat. No. 4,686,781 issued to Bury, U.S. Pat. No. 4,777,743 issued to Roehrig Jr., and U.S. Pat. No. 4,458,432 issued to Stempski. Respectively none of the above shoe designs accomplish a total, complete and independent variable weight or weight shoe function.

The prior art designs for the field of weighted shoes: the weights are placed on various locations of the upper portions of the shoe, are not * concentrated in one part of the shoe, do not cover the entire movement of the foot, heel to toe etc. Use an array of various shapes of weights and an array of buckles and fasteners, are not independent from the upper portion of the shoe and are weighted insoles that do not belong to the actual construction of the shoe. All of these limitations make it tedious and time consuming to the wearer of these shoes.

It is an objective of the present invention to provide a shoe that focuses only on the rubber sole of the shoe for the use of variable weight exchange and attach ability. It is a further objective to provide a shoe that uses weights of one geometrical shape only. It is a further objective to provide a shoe that allows weights to be distributed and centralized throughout their entire foot and not just in the heel to middle section of the foot. It is still a further objective of the invention provide a weighted shoe that does not interfere with the upper portion or material of the shoe; upper forefoot, heel, foreword end, and after end, etc. It is yet a further objective to allow the wearer to adjust and remove variable weights by the use of tools (allen wrench) or manually by means of a turning knob.

The objectives in the present art are respectively limited in the prior art and none of the inventions found, studied or researched include all of the requirements identified.

SUMMARY OF THE INVENTION

The present invention eliminates all of the inconveniences of prior art weighted shoe inventions and delivers all the objectives *described in the background of the invention. A weight sporters walking shoe provides a flexible rubber sole. The sole is made of a hard durable rubber material. The upper part of the shoe has an upper, forefoot, enclosed section, a heel-enclosed section, and a first and second side to the heel-enclosed section. The rubber sole portion has a foreword and after end and bottom surface. The sole of the shoe has five drilled out holes of different circular circumferences, which run in a tube horizontal fashion, to allow circular weights of different sizes and weight to fit in and out of the holes. The circular weights are made of metal steel and can be placed inside the five holes that run along the entire side of the shoes sole. The weights are smooth and round, with a top and bottom circular fine cut. The weights are equipped with a machined thread of half an inch on one end to allow for smooth attachment into the horizontal holes of the shoe's rubber sole. The horizontal holes are also lined with a smooth hard plastic coating; in a circular circumference tube fashion, to also allow for smooth attachment of the circular weights.

In the outer side of the rubber sole, the holes are equipped with a nipple ring of individual diameter, manufactured and placed a half inch inside the entrance of each hole to allow the machined threaded side of the weight to secure and tighten into the horizontal holes in the shoes rubber sole. In a variation of the invention, the weights are equipped with a turning knob of half an inch to allow for manually securing and tightening the weights into the sole of the shoe. Directly on top of the turning knob, there is also an allen wrench insert to allow tightening and securing of the weights by means of an allen wrench tool. This allows the weights to be secured and tightened manually or by the means of tools.

In yet a further variation the circular weights are of different weight and are stamped with numbers on each side to indicate the amount of heaviness. They are also of different circular circumference, according to the heaviness of each weight. They are also individually shaped and formed to attach to the five individual horizontal holes that extend along the side of the shoes rubber sole. The weight's shape is not changed in the variation of heaviness; they remain circular to allow simplicity.

In yet another variation of the invention there is also a rubber ring of one sixteenth of an inch above the half inch machined thread of the weights to allow a tight pressure grip by the use of the rubber ring.

DETAILED DESCRIPTION OF THE PREFERRED EMBODIMENT

Figure 1:
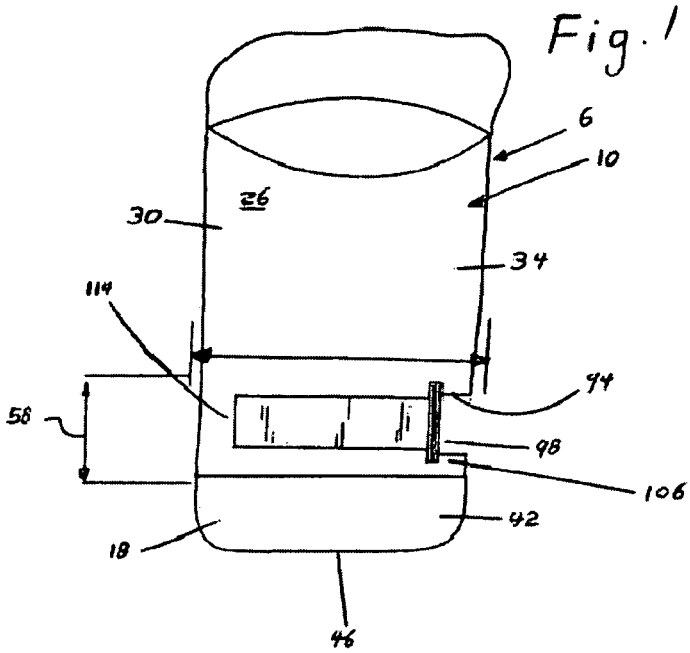
FIG. 1 is a front elevation of a weight sporters athletic shoe with a partial break-away front elevational view of an embodiment of the removable shoe weights.
Figure 2:
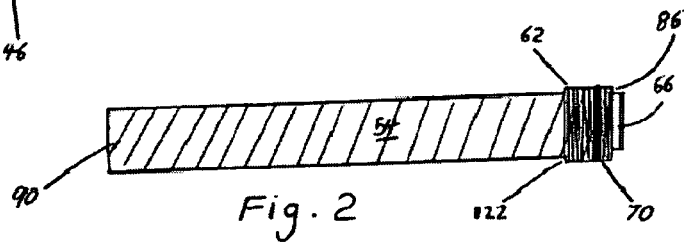
FIG. 2 is a perspective view of the FIG. 1 embodiment illustrating an embodiment of a weight turning knob, machined threads and a rubber pressure ring.
Figure 3:
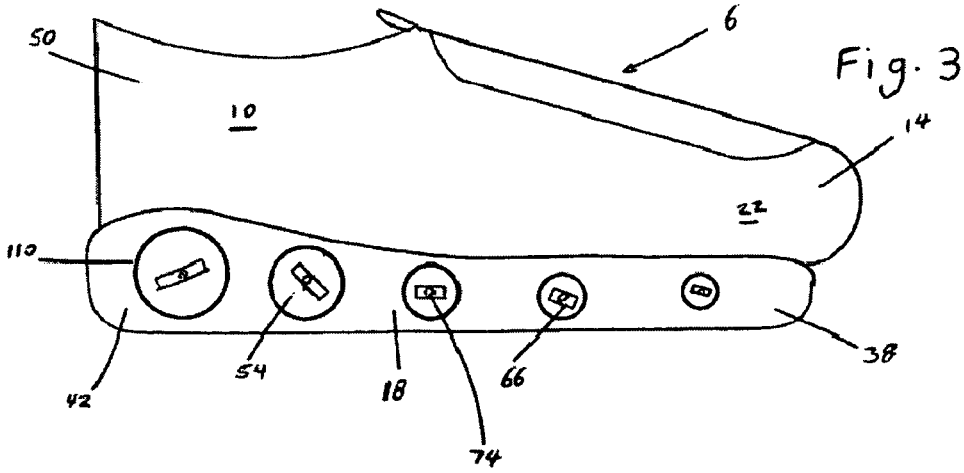
FIG. 3 is a side elevational of the five FIG. 1 embodiments attached to the weight sporters athletic shoe.

As illustrated in FIGS. 1-9, an athletic shoe, (weight sporters) 6 may be constructed from the following components. As illustrated in FIGS. 1 and 3, an athletic shoe 10 having an upper portion 14 and a rubber sole portion 18 is used. There is a forefoot enclosing section 22 and a heel-enclosing section 26, both located on the upper portion 14. There are two sides of the heel-enclosing section 26 first side as shown 30, and second side as shown 34 the rubber sole portion 18 has a foreword end 38, an after end 42 and a bottom surface 46 the after end 42 extends upwardly from the bottom surface 46 to a top edge 50 and along the heel-enclosing section 26 of the upper portion 14. As illustrated in FIGS. 1-5 circular, round removable shoe weights 54 are provided. The weights 54 are formed of a steel, metal material and may be covered in a plastic rubber coating and are shaped to conform to the cavity holes 58 that extend horizontally from the after end 42 to the foreword end 38 of the rubber sole 18 of the shoe. The weights 54 are circular with a top edge 86 and a bottom edge 90 means 66 and 74 are provided for removing and attaching the weights 54 to the cavity holes 58 of the rubber soles 58 portion of the shoe.

Figure 4:
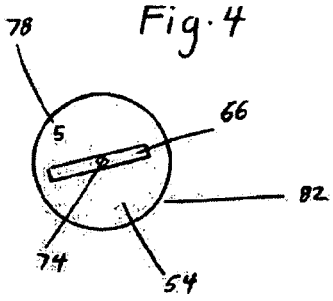
FIG. 4 is a side elevational of the FIG. 1 embodiment illustrating the turning knob and the alien wrench orifice.
Figure 5:
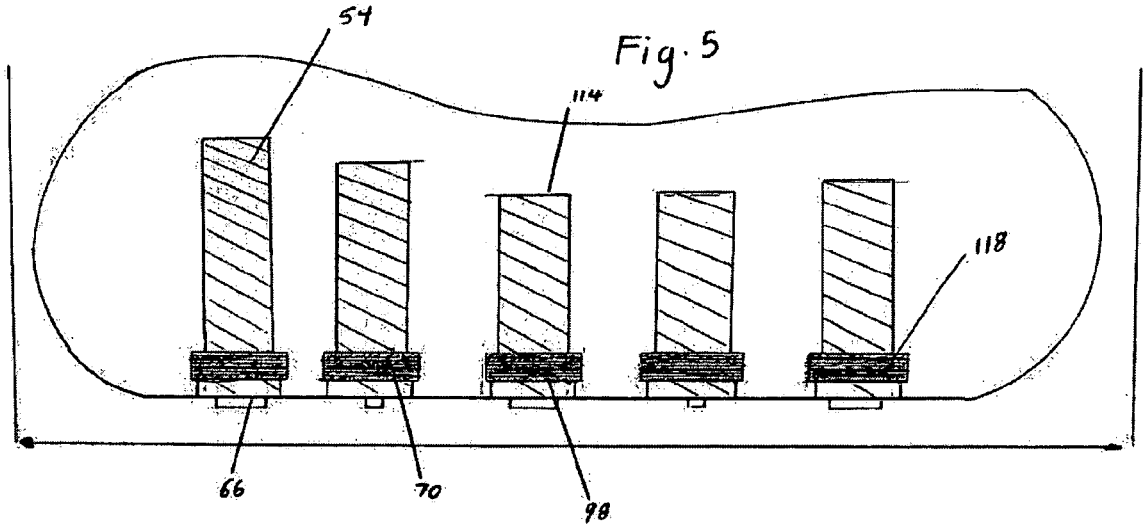
FIG. 5 is a break-away plan elevational view of the FIG. 1 embodiment illustrating the removable shoe weights.

In a variation of the invention, as illustrated in FIGS. 2-5 the means 66, 74 for removing and attaching the weights 54 to the bottom side of the sole portion 18 further comprises circular cavity holes 58 that extend horizontally from the sole portions 18 after end 42 to the foreword end 38 of the athletic shoe. The cavities 58 are circular, round, with a back portion 114 and may be two or two and half inches deep and may be of different circumferences, as shown in FIG. 5 to allow for weights 54 size and heaviness as shown in FIGS. 3-4 the cavities 58 entrance also has an expansion 94 that increases each circular cavity's diameter a sixteenth of an inch and extends half an inch up and down to allow a tight fit of weights 54, there is also a machined threaded metal (and relates in size and diameter according to the diameter and size of each individual cavity) nipple ring 98 that is at the entrance of each cavity 58 the inside of the cavities 58 are covered entirely with a smooth hard nylon coating 110.

Figure 6:
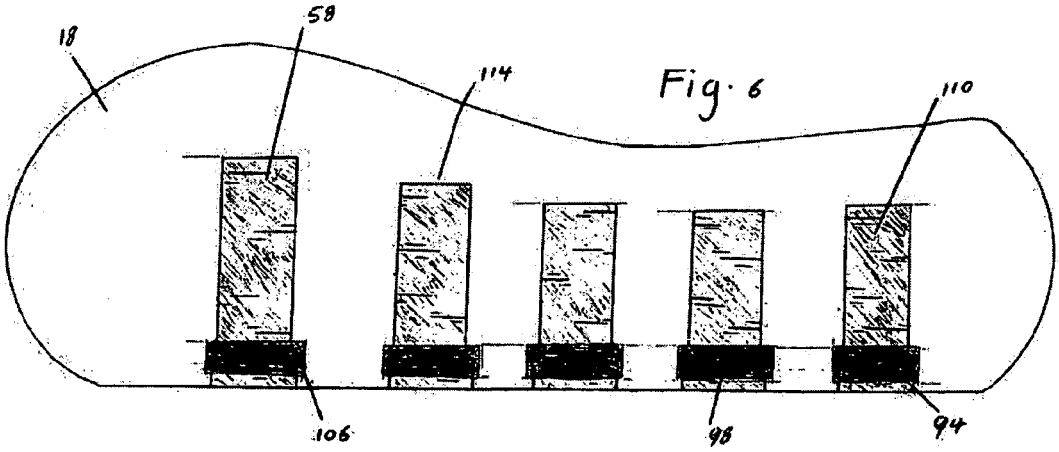
FIG. 6 is a break-away plan elevational view of the athletic shoe illustrating five cavities that extend along the rubber sole of the shoe.
Figure 7:
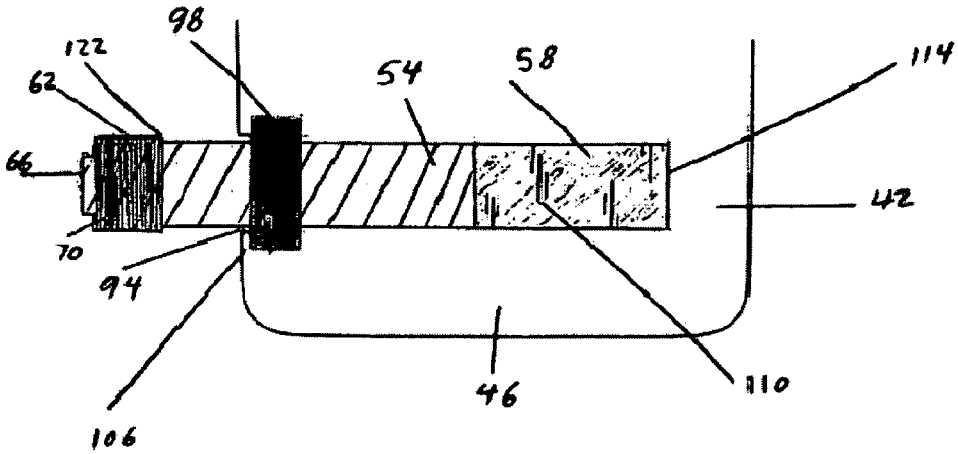
FIG. 7 is a partial break-away front elevational view of FIG. 6 cavities illustrating a nipple ring mechanism.
Figure 8:
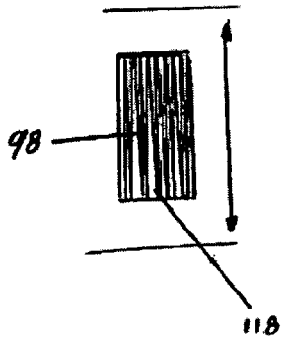
FIG. 8 is a break-away plan view of FIG. 7 nipple ring illustrating machined threads that coincide with FIG. 2 machined threads and rubber pressure ring.
Figure 9:
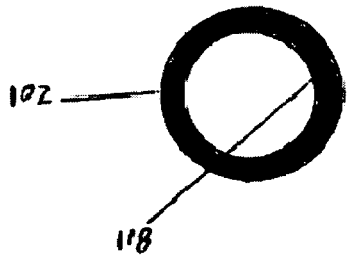
FIG. 9 is a cross-sectional side elevation of FIG. 8

In a variation of the invention the means 106 of holding nipple ring 98 in place further comprises a section of the rubber sole 18 that covers each nipple ring entirely as shown in FIGS. 3, 5, and 6. Each nipple ring 98 is also one eighth and a half inch thick 102 from its outside. The cavities 58 are sized, shaped and disposed to receive each shoe weight. A turning knob 66 located at the top edge of each weight 54 is provided. An alien wrench cavity 74 located at the top of the turning knob 66 is also provided. Each weight 54 is also machined threaded 62 and equipped with rubber ring 70, each sized and shaped at the top edge 86 of each weight 54. As shown in FIGS. 2-5 a turning knob 66 is fixedly attached to the top edge 86 of each weight 54. In use, the weight 54 is inserted into its individual cavity 58 the turning knob 66 is turned manually or with a alien wrench 74 the machined threads 118 of the nipple ring 98 secure with the machined threads 62 of the top edge 86 of the weight 54 the rubber ring 70 allows a tight *pressure fit of each weight 54 when inside the athletic shoes cavities 58 thus the weights 54 are removably attached to the athletic shoe.

In operation the weights are attached and released by turning the turning knob 66.

The weight sporter athletic shoe 6 has been described with reference to particular embodiments. Other modifications and enhancements can be made without departing from the spirit and scope of the claims that follow.

What is claimed is:

1. A weight sporters athletics shoe comprising:

a rubber flexible sole for a shoe having a top surface a bottom surface;

a ball of the foot receiving area;

an arch receiving area;

a heel receiving area;

an after and forward end;

said flexible sole having five drilled out holes, said drilled out holes drilled not entirely all the way through the sole and extending in a row in horizontal tube fashion and along flexible sole from the heel receiving area to the ball of the foot receiving area, said drilled out holes are of different circular circumference and individually fitted around a metal nipple ring; and removeable shoe weights cylindrical in shape and of various sized circumferences and having machined threads of half an inch on a top edge to attach inside said drilled out holes.

2. A weight sporters athletic shoe as described in claim 1 wherein the drilled out holes have a washer nipple ring positioned half an inch in from the inside of the entrance of each drilled out hole, said nipple ring having a machined threaded inner circumference;

whereby said weights, when inserted into said drilled out holes and lined up with the threads of the weight, the machined threads of the nipple ring will fasten and secure each weight to the athletic shoe, and each nipple ring is sized and shaped according to the diameter of each individual drilled out hole.

3. A weight sporters athletic shoe of claim 2 further comprising five circular rounded weights of different circumference and heaviness.

4. A weight sporters athletic shoe as described in claim 3 wherein the weights have a half inch turning knob with an allen wrench orifice on top of the knob to allow attachment of said weights manually or with a tool, said tool is an allen wrench; and said weights having a rubber ring above the machined thread on the top edge of each weight, wherein said rubber ring allows for a tight pressure fit when said weights are inserted into said drilled out holes.

5. A weight sporters athletic shoe as described in claim 1 wherein each hole has a threaded circular nipple ring of various circular circumference and placed at the entrance of each said horizontal hole.

6. A weight sporters athletic shoe as described in claim 5 wherein a hard plastic nylon lining covers the entire inside of the drilled out holes.

7. A weight sporters athletic shoe as described in claim 2 wherein the nipple rings each have an individual circular diameter made of metal steel and have a machined threaded inside to allow securing of weights.

8. A weight sporters athletic shoe as described in claim 4 further comprising a half inch turning knob at the top edge of each weight.

9. A weight sporters athletic shoe as described in claim 4 wherein the rubber ring of each individual drilled out hole is positioned on the top edge of the weight and above the machined threaded section and located between the thread and turning knob.

10. A weight sporters athletic shoe as described in claim 1, further comprising an expanded portion of the drilled out hole, the expanded portion positioned at the entrance to the drilled out hole and having a diameter greater than the rest of the drilled out hole.

11. A weight sporters athletic shoe as described in claim 10, wherein the expanded portion is of one sixteenth inch greater in diameter than the rest of the drilled out hole and is positioned from the entrance of each hole to one half an inch from the entrance.

12. A weight sporters athletic shoe as described in claim 7 wherein the nipple ring is enveloped by the shoe's sole, to allow the shoe's sole to cover and hold the ring.

13. A weight sporters athletic shoe as described in claim 12, further comprising a section of shoe's sole rubber holds the nipple ring in place, the section is a ¾ inch thick and allows said nipple ring to be held in place by securing the outer portion of said nipple ring.

* * * * *